United States Patent [19]

Owings

[11] 4,430,892

[45] Feb. 14, 1984

[54] PRESSURE LOSS IDENTIFYING APPARATUS AND METHOD FOR A DRILLING MUD SYSTEM

[76] Inventor: Allen J. Owings, 710 St. Ives, Houston, Tex. 77079

[21] Appl. No.: 317,004

[22] Filed: Nov. 2, 1981

[51] Int. Cl.[3] ..... E21B 47/10

[52] U.S. Cl. ..... 73/151; 175/48; 364/422

[58] Field of Search ..... 73/151, 155; 175/48; 364/422

[56] References Cited

U.S. PATENT DOCUMENTS

| | | | |
|---|---|---|---|
| 3,477,526 | 11/1969 | Jones et al. | 73/151 |
| 3,595,075 | 7/1971 | Dower | 175/48 |
| 3,800,277 | 3/1974 | Patton et al. | 175/48 |
| 4,282,939 | 8/1981 | Maus et al. | 175/48 |

FOREIGN PATENT DOCUMENTS

| | | | |
|---|---|---|---|
| 7921793 | 1/1980 | United Kingdom | 73/155 |

OTHER PUBLICATIONS

8/20/79 Issue of Oil & Gas Journal; Sensitive Delta--Flow Method Detects Kicks or Lost Returns; L. D. Maus, B. A. Peters, D. J. Meador, Exxon Production Research Co., Houston; pp. 125-132.

*Primary Examiner*—Howard A. Birmiel
*Attorney, Agent, or Firm*—Guy E. Matthews

[57] ABSTRACT

Methods and means are disclosed for the monitoring of conditions in a mud circulation system as used in the drilling of oil and gas wells, and to quickly detect and indicate pressure failures that may occur in that system to thereby allow for the maximum time and opportunity for remedial action.

4 Claims, 2 Drawing Figures

PRESSURE LOSS IDENTIFYING APPARATUS AND METHOD FOR A DRILLING MUD SYSTEM

FIELD OF THE INVENTION

The present invention generally relates to drilling mud circulation systems as used during the drilling of oil and gas wells. More particularly, the present invention relates to methods and apparatus to detect and identify failures in such systems.

BACKGROUND OF THE INVENTION

Mud circulation systems have been used for many years in the drilling of deep wells and in that time, many leaks have developed in such systems, the leaks causing lost time and excessive costs but more importantly, the leaks sometimes causing loss of the well or the loss of life. Drilling mud is a term used for a variety of drilling fluids such as mixtures of water, oil, chemicals, clays, and any other materials that will produce desired properties such as density, viscosity, and gas penetration resistance.

Drilling mud is normally sucked from the mud tank to a battery of mud pumps where it is pressurized and pumped through a series of pipes, control devices, measuring devices, a drilling swivel, a kelley joint, down the drill string, out of the bit, up the annulus to the mud riser, through the mud return line having more measurement and control devices, through equipment to separate cuttings and back to the mud tank for reconditioning and recirculation. From the drillers position, the standpipe, hose and the drilling swivel are the only parts of the mud circulation route described above that are visible and should pressure be lost at some point along the route, valuable time passes before he realizes the loss and attempts to identify the cause and to correct the problem if it is not too late to do so. Such a loss of time worsens the results of the leak due to: the extremely abrasive qualities of most drilling muds and their ability to rapidly enlarge a leak path; the possibility of a blow out before the leak can be fixed; reduced drilling rates and premature replacement of equipment, to name a few.

The driller may have at his console a number of indicators in addition to drilling controls, such indicators showing, rate of penetration, weight on the hook, bit RPM and mud pressure, all of which usually hold his full attention as he operates the controls. It is therefore desirable that he be furnished with a method and apparatus to correlate and logic out the cause of failures from additional data such as mud pump speed, mud pump output, standpipe pressure, mud return rate and a multiplicity of pressures along the mud circulation route, as does the present invention. Hayward, in U.S. Pat. No. 2,290,179 discloses a method of signaling a predetermined percent increase in pump speed to indicate a washout but makes no attempt to correlate increased pump speed with other indicators such as changes in flow rates, or system pressures so as to prevent a signaling of washout when in fact some other failure has occurred.

McArthur, U.S. Pat. Nos. 3,895,527; 3,898,877; 4,010,642; and 4,018,088 discloses the measure of downhole pressure by use of a special tube run downhole, as does Tricon U.S. Pat. No. 3,985,027.

SUMMARY OF THE INVENTION

The present invention comprises methods and apparatus for monitoring mud pump speeds, mud flow rates and mud pressures at appropriate locations along the circulation route of the drilling mud in a mud circulation system used to drill oil and gas wells, and to quickly identify a mud pressure failure when a failure occurs.

DESCRIPTION OF THE PREFERRED EMBODIMENT

Figure 1:
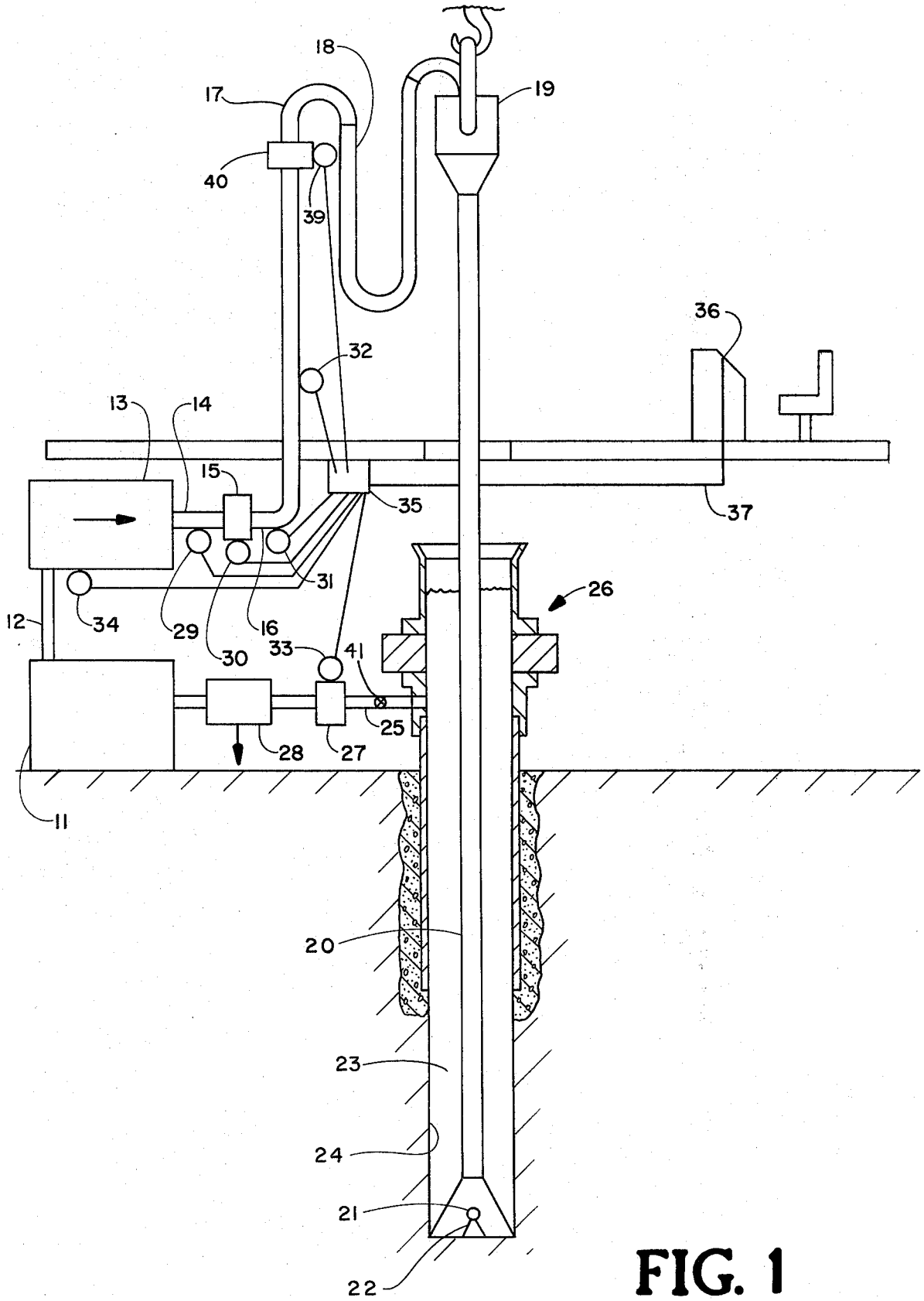
FIG. 1 illustrates the route of a basic mud circulating system as used in the drilling of oil and gas wells.

As shown in FIG. 1 mud is sucked from mud pit 11 through pipe 12 by mud pump 13, pump 13 pressurizing the mud which flows through pipe 14 to mud pump flow meter 15 and thence through pipe 16 to standpipe 17. From standpipe 17, the mud flows through flow meter 40, through hose 18, through power swivel 19, through drill string 20 and out jets 21 formed through bit 22 and thence up annulus 23 formed between drill string 20 and bore hole wall 24 to pipe 25 interconnected with a conventional pressure control assembly shown generally at 26. From pipe 25, the mud flows through valve 41, return mud flow meter 27, through mud cleaning equipment as at 28, after which it returns to mud tank 11 for reconditioning and recirculation. The foregoing description is that of a basic conventional mud circulation system to which the present invention relates.

Figure 2:
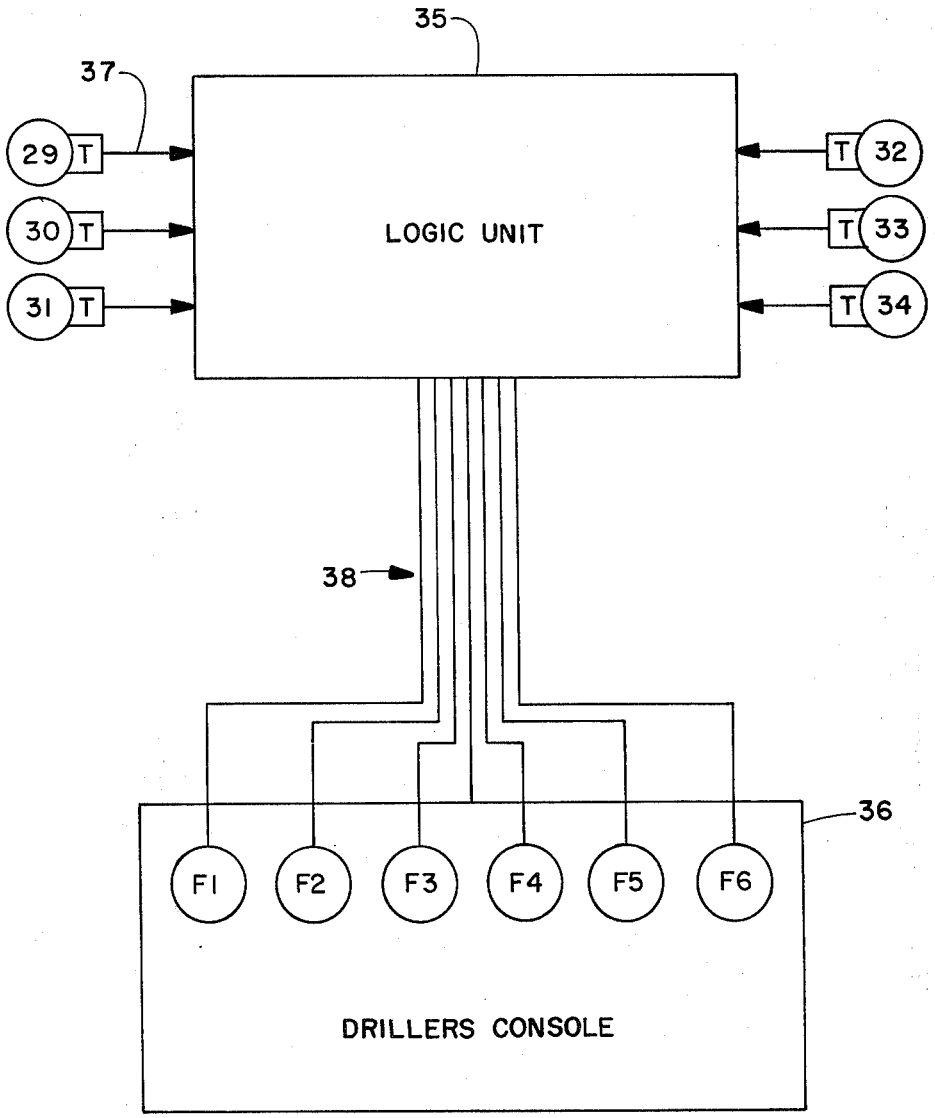
FIG. 2 shows a schematic of instrumentation that may be assembled to perform according to the present invention.

Sensors typically required to operate according to the present inventions are shown in FIG. 1 and FIG. 2 as follows; pressure sensor 29 for pump outlet pressure; flow rate sensors 30 and 39 mounted on mud pump flow meters 15 and 40, respectively; pressure sensor 31 mounted on pipe 16; pressure sensor 32 mounted on standpipe 17; flow rate sensor 33 mounted on return mud flow meter 27 and mud pump speed sensor 34. According to the requirements of each mud circulation system, more or fewer sensors may be used in the practice of the present invention. Each sensor includes a suitable transmitter T, of conventional design.

By monitoring the data received from the sensors, the driller may quickly identify system failure according to Table 1 and 2, below.

TABLE #1

| | WITH MUD RETURNS (OPEN SYSTEM) | | |
|---|---|---|---|
| MEASURED VALUE ↓ / FAILURE → | Drill String Washout | Mud Pump Failure | Surface System Leak |
| Standpipe Pressure | Decrease | Decrease | Decrease |
| Mud Pump Speed (SPM) | Increase | Same or Slight Increase | Increase |
| Mud Pump Flow Rate | Increase | Decrease | Increase |
| Mud Return Rate | Increase | Decrease | Decrease |
| Failure Indicator → | F1 | F2 | F3 |

TABLE #2

| MEASURED VALUE ↓ / FAILURE → | WITHOUT MUD RETURNS (CLOSED SYSTEM) Downhole Csg. or Wall Failure | Mud Pump Failure | Surface System Leak |
|---|---|---|---|
| Standpipe Pressure | Decrease | Decrease | Decrease |
| Mud Pump Speed (SPM) | Increase | Increase | Increase |
| Mud Pump Flow Rate | Increase | No Flow | Increase |
| Mud Return Rate | No Flow | No Flow | No Flow |
| Standpipe Flow Rate | Increase | No Flow | No Flow |
| Failure Indicator → | F4 | F5 | F6 |

To receive data from the sensors, to correlate the data per Tables 1 and 2 above and to activate the proper failure indentifier, a logic and command unit 35 is suitably mounted and interconnected with the sensors as by transmission lines 37 and with failure indicators as by transmission lines 38 to allow for instant indentification of a failure, when one occurs. Failure identifiers may be mounted on the driller's console as at 36 so as to get his immediate attention by such means as a flashing sign which identifies the failure.

The sensors, meters, identifiers, transmissions, lines, the logic and command unit may be of the hydraulic, pneumatic or electric type, or any combination thereof, all components being commercially available.

OPERATION OF THE INVENTION

When the mud circulation system is in operation, the logic and command unit continually receives data from all sensors and compares it to the conditions for each of the six failure modes defined by Table 1. When any one of the set of conditions is met by current data from the sensors, the logic unit recognizes the fact and issues a command to activate the corresponding failure indicator mounted on the driller's console to thereby afford maximum opportunity for remedial action. It is therefore evident that the present invention teaches a novel, method and means to quickly and accurately identify drilling mud circulation system pressure failures to thereby prevent; damage to property, excessive costs, waste of time, possible loss of the well and the energy therefrom, damage to the environment in case of potential blowouts, and sometimes the loss of life. Variations will occur to those skilled in the art that are well within the spirit of the present invention, in light of its teachings.

What is claimed, is:

1. In an oilwell drilling mud circulation system having continuing mud returns, a method of identifying system failures, comprising the steps of: monitoring standpipe pressure, monitoring mud pump speed; monitoring mud pump flow rate; monitoring mud return flow rate; signaling a drill pipe washout if standpipe pressure decreases and mud pump speed, mud pump flow rate and mud return flow rate increase; signaling a mud pump failure if mud pump speed increases and mud pump flow rate decreases; signaling a leak in the surface system when standpipe pressure decreases, mud return flow rate decreases, and mud pump flow rate remains constant.

2. In an oilwell drilling mud circulation system having continuing mud returns, apparatus for identifying system failures, which comprises: means for monitoring standpipe pressure; means for monitoring mud pump speed; means for monitoring mud pump flow rate; means for monitoring mud return flow rate; means for signaling a drill pipe washout if standpipe pressure decreases and all mud flow rates increase; means for signaling a pump failure if mud pump speed increases while the mud pump flow rate does not increase; means signaling a leak in the surface system when standpipe pressure decreases, mud return flow rate decreases, and the mud pump flow rate remains constant.

3. In an oilwell drilling mud circulation system wherein mud circulation is intentionally stopped for pressure testing in a closed system, a method of identifying system failures, comprising the steps of: monitoring standpipe pressure; monitoring mud pump flow rates at selected points, monitoring mud return flow rate; signaling a downhole pressure loss if standpipe pressure decreases and mud pump flow rate measured at the standpipe increases; signaling a mud pump failure if standpipe pressure decreases and mud pump flow rate measured at the mud pump discharge is nil; signaling a surface system leak if mud pump flow rate measured at the standpoint is nil and mud pump flow rate measured at the mud pump discharge increases.

4. In an oilwell drilling mud circulation system wherein mud circulation is substantially stopped for pressure testing in a closed system, apparatus for identifying system failures, which comprises: means for monitoring standpipe pressure; means for monitoring mud pump flow rates both at the mud pump discharge and on the standpipe; means for monitoring mud return flow rate; means for signaling a downhole pressure loss if standpipe pressure decreases and mud pump flow rate measured on the standpipe increases; means for signaling a mud pump failure if standpipe pressure decreases and mud pump flow rate measured at the pump discharge is nil; and means for signaling a surface system leak if mud pump flow rate measured on the standpipe is nil but mud pump flow rate measured at the mud pump discharge increases.

* * * * *